United States Patent [19]

Wojdyla

[11] 4,397,574

[45] Aug. 9, 1983

[54] RELOADABLE RIBBON CASSETTE

[75] Inventor: Gary A. Wojdyla, Ithaca, N.Y.

[73] Assignee: NCR Corporation, Dayton, Ohio

[21] Appl. No.: 291,137

[22] Filed: Aug. 7, 1981

Related U.S. Application Data

[63] Continuation of Ser. No. 88,883, Oct. 29, 1979, abandoned.

[51] Int. Cl.[3] ..... B41J 33/10

[52] U.S. Cl. ..... 400/196.1; 400/224; 400/234; 400/235.1

[58] Field of Search ..... 400/194, 195, 196, 196.1, 400/207, 208, 208.1, 224, 234, 235.1

[56] References Cited

U.S. PATENT DOCUMENTS

| | | | |
|---|---|---|---|
| 2,930,470 | 3/1960 | Roller et al. | 400/235.1 X |
| 3,260,344 | 7/1966 | Doyle | 400/208 |
| 3,720,954 | 3/1973 | Czyryk | 400/196 X |
| 3,726,381 | 4/1973 | Murphy | 400/196.1 |
| 3,871,507 | 3/1975 | Perry et al. | 400/196.1 X |
| 3,924,727 | 12/1975 | Morelli | 400/208.1 |
| 3,977,512 | 8/1976 | Teagarden et al. | 400/196.1 X |
| 4,046,247 | 9/1977 | Laspesa et al. | 400/196 |
| 4,157,224 | 6/1979 | Purzycki et al. | 400/196 X |
| 4,209,261 | 6/1980 | Bell et al. | 400/224 X |
| 4,213,715 | 7/1980 | Haftmann et al. | 400/234 X |
| 4,240,757 | 12/1980 | Hanna | 400/207 X |

FOREIGN PATENT DOCUMENTS

| | | | |
|---|---|---|---|
| 2317971 | 10/1974 | Fed. Rep. of Germany | 400/196 |
| 2717076 | 10/1978 | Fed. Rep. of Germany | 400/196.1 |
| 50-144518 | 11/1975 | Japan | 400/194 |
| 12870 | of 1913 | United Kingdom | 400/196.1 |
| 29235 | of 1913 | United Kingdom | 400/196.1 |

OTHER PUBLICATIONS

IBM Technical Disclosure Bulletin, "Endless Fold Ribbon Cartridge", Gardineer, Jr., vol. 15, No. 2, Jul. 1972, p. 543.

*Primary Examiner*—Ernest T. Wright, Jr.
*Attorney, Agent, or Firm*—J. T. Cavender; Wilbert Hawk, Jr.; George J. Muckenthaler

[57] ABSTRACT

A ribbon cassette is fastened on one side of a printer and is operator reloadable. The endless ribbon is loaded in coil form and is driven from the cassette in a path past the printing station of the printer and back into the cassette where it assumes a random form corresponding to a stuffing type cassette.

14 Claims, 5 Drawing Figures

RELOADABLE RIBBON CASSETTE

This application is a continuation of application Ser. No. 088,883, filed Oct. 29, 1979, now abandoned.

BACKGROUND OF THE INVENTION

In the field of ribbon cassettes for use in a printer, an ink ribbon is usually carried in a manner and trained in a path to provide a supply of freshly-inked ribbon at the printing station. In one arrangement, an endless ribbon may be contained in coil form within the cassette with a portion of the coil being directed in a path outside the cassette and past the printing station and wherein the ribbon is uncoiled from an inside diameter of the coil and then recoiled on the outside diameter of the coil after passing the printing station.

An endless ribbon in another form may be contained within the cassette in stuffing manner with a portion of the ribbon being directed in a path past the printing station, and wherein the ribbon is precisely controlled at the exit of the cassette and is then returned to the cassette and placed in random manner and form therein after passing the printing station.

Regardless of whether the cassette contains the endless ribbon in coil form or in stuffed form, an important requirement in many of the various cassettes is to provide a design so as to enable an increase in or to lengthen the life of the ribbon.

In the case of the coiled ribbon within the cassette, the design could also include inking or reinking means so as to increase the life of a ribbon having limited surface or usable area. While it would be more difficult to provide reinking means within the cassette for a stuffing type ribbon, such inking or reinking means could, if necessary, be positioned adjacent the printing station.

Representative prior art in the area of stuffing-type cassettes and of coil-type cassettes includes IBM Technical Disclosure Bulletin Vol. 15, No. 2, page 543, dated July, 1972, and entitled Endless Fold Ribbon Cartridge, by B. Gardineer, Jr., which shows a cartridge for an inked ribbon, driven rollers with an elastomeric layer, a spring clip at the exit and a plurality of fingers for folding the ribbon into a sine wave shape.

British Patent Specification No. 12,870, issued to Burk on June 4, 1913, shows a container, rollers for laying ribbon in loose folds and a spring at the exit of the container.

British Patent Specification No. 29,235, issued to Stockall on Dec. 18, 1913, shows a magazine, a feed roller and a friction roller for the ribbon in folding thereof after passing guides and type wheels.

U.S. Pat. No. 4,046,247, issued to R. E. LaSpesa et al. on Sept. 6, 1977, discloses a cartridge for an endless ribbon which is stored in a coil, prior to its usage and then withdrawn by unwinding the coil when the cartridge is moved in one direction for mounting on the printer. The ribbon moves in a single direction past the print head and along a platen, and the ribbon may be replaced in the cartridge by threading the ribbon about a plurality of spaced rollers.

SUMMARY OF THE INVENTION

The present invention relates to a ribbon cassette and more particularly to a reloadable ribbon cassette wherein an endless ribbon is inserted or loaded into the cassette in coil form and a loop of the coil is directed in a path outside the cassette and past a printing station and then back into the cassette where the ribbon is stored in a random or stuffing type manner.

The cassette is secured to the printer frame at one side of the printing station and has a pair of drive rollers at the ribbon entrance to the cassette with one of the ribbon drive rollers being fixed in position and driven through a gear train system from the cam shaft of the printer. A one-way clutch is provided in the gear train system for taking up any slack ribbon outside the cassette and for enabling the driving of the ribbon in one direction to correct the slack condition. The other drive roller at the entrance to the cassette operates as a pinch or pressure roller and is movable toward and away from the fixed drive roller to permit ease of threading the ribbon between the rollers.

The endless ribbon in coiled form is loaded or placed into the cassette and the end loop of the ribbon is threaded in a manner to provide a strand of the ribbon loop through the cassette exit, past a drag spring and through the cassette entrance at the drive rollers to effect the threading of the cassette. The end loop is then pulled away from the drag spring area of the cassette and is threaded past the print heads and ribbon guides and is then trained back through the throat between the drive rollers to enter the cassette and to be stored therein in stuffing manner. For a certain period of time after loading the ribbon coil into the cassette and operating the printer, the cassette contains ribbon in coil form and ribbon in stuffing form, and with further printer operation, the cassette contains only ribbon in stuffing form for continued use until the cassette is reloaded with a new coil of ribbon. In normal printing operation, the coil or spool of ribbon unwinds as the ribbon is pulled from the cassette and when the coil or spool is completely unwound, the ribbon then assumes the stuffing form and operates in random manner.

In view of the above discussion, the principal object of the present invention is to provide a ribbon cassette for a printer and which cassette is reloadable by the operator.

An additional object of the present invention is to provide a ribbon cassette for accommodating a ribbon of greater length.

Another object of the present invention is to provide a ribbon cassette which receives a ribbon in coil form and is threaded past a printing station and then returns to the cassette in stuffing form.

A further object of the present invention is to provide a reloadable ribbon cassette which has a ribbon initially in coil form and which is unwound to be directed in a path past a printing station and is then returned to the cassette to be stored in stuffing or random manner.

Additional advantages and features of the present invention will become apparent and fully understood from a reading of the following specification taken together with the annexed drawing.

DESCRIPTION OF THE PREFERRED EMBODIMENT

Figure 1:
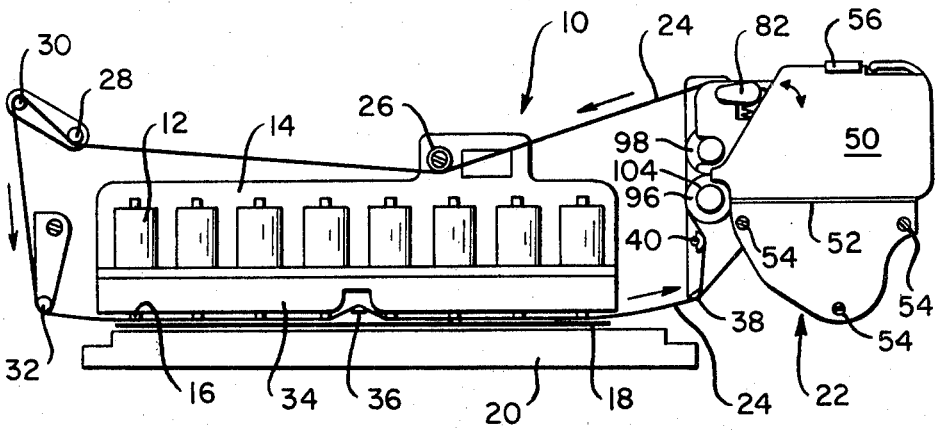
FIG. 1 is a front elevational view of a portion of a printer incorporating the subject matter of the present invention.

Referring now to FIG. 1, there is shown a printer of the single station impact matrix type, generally designated as 10, which includes a plurality of printing solenoids 12 carried on a carriage 14 which is caused to be moved left to right and right to left, i.e., in reciprocating manner, for bidirectional printing on record media 18 such as journal paper or inserted forms. Each of the printing solenoids 12 is connected with a print wire 16 in well-known manner for printing in dot matrix character form on the record media 18 and wherein the printing is generally accomplished in ascending order, that is, where each line of dots and each line of characters is printed above the prior line. A line of printing requires seven passes of the carriage 14 to print one line of characters for a standard seven dot height character. The journal paper or inserted form 18 is caused to be placed between the ends of the print wires 16 and a platen 20 which comprise the printing station of the present invention.

A ribbon cassette generally designated as 22 is supported at the right side of the printer 10 by suitable means and the ribbon 24 travels in a path as indicated by the arrows from the exit of the cassette 22 past an oscillating guide 26 and a stationary guide 28, and then past a spring-loaded guide 30 which compensates for excessive frictional forces in the ribbon 24 in left to right travel and which aids in proper operating tension on the ribbon 24.

The next guide 32 is adjustable and directs the ribbon 24 onto the main ribbon guide 34 which moves back and forth with the printer carriage 14. The main guide 34 includes a surface which serves to hold the ribbon 24 in a flat condition under the solenoid print wires 16 and also to maintain proper skew of the ribbon 24 as it passes from one side of the carriage 14 to the other side. The skew in the ribbon 24 provides for evenly distributing the surface of the ribbon 24 to the impact of the print wires 16 across the width of the ribbon 24. At the center of the main ribbon guide 34, the ribbon 24 is directed over a guide 36 and the cassette 22 includes guides 38 and 40 as a portion thereof to set the path of and direct the ribbon 24 toward the entrance of the cassette 22.

Figure 2:
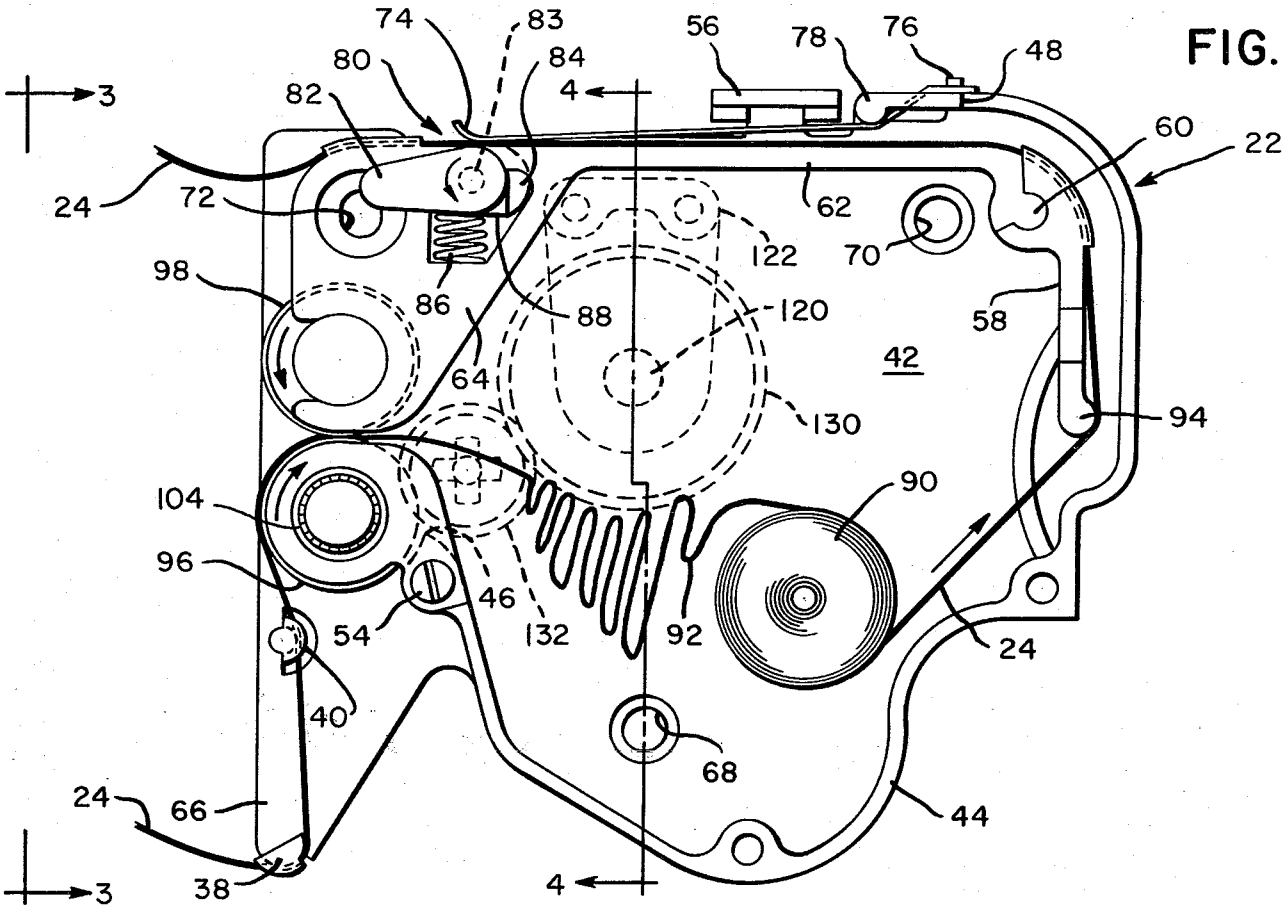
FIG. 2 is an enlarged view of the reloadable ribbon cassette in its ribbon loaded condition and with the front cover removed therefrom.

The ribbon cassette 22 is shown enlarged in FIG. 2 and takes the form of an irregular shaped enclosure having a back portion 42 with a continuous wall portion 44 starting at a point 46 and following around the enclosure to a point 48 with the wall portion 44 being an integral molded part with the back portion 42 and forming the body of the cassette 22. A cover or front portion 50 (FIG. 1) includes a living hinge 52 across the central portion of the cover 50. The cover 50 is secured to the enclosure by means of screws 54 at three locations. The upper portion of the cover 50 is opened and closed by operating a latch member 56 and allowing the upper portion to swing about the hinge 52.

An interior wall portion 58 (FIG. 2) is likewise an integral part of the back portion 42 and includes a pivot 60 for an upper movable wall or pressure arm 62 which also includes as a part thereof a downwardly extending arm portion 64 which will be described in more detail later in this specification. The body of the cassette 22 also includes a downwardly extending portion 66 which provides support for the ribbon guides 38 and 40 in directing the ribbon 24 from the printing station toward the entrance of the cassette 22. Apertures 68, 70 and 72 are provided for securing the cassette 22 to the printer 10. An elongated leaf spring 74 is connected by a pin 76 at the upper part of wall portion 44 near an extremity thereof (adjacent point 48) and is trained under a rigid guide portion 78 and extends therefrom to a point adjacent a pivot assembly 80. As illustrated, such assembly 80 includes a pivot arm 82 and a finger 84, which finger 84 engages with the spring 74. Upon manual movement counterclockwise of the arm 82 about a pivot 83, as shown by the arrow, the finger 84 is effective to engage a rearward portion 75 of the leaf spring 74 (see FIG. 3) and to raise the spring 74 above the upper surface of the movable pressure arm 62 for removing a normal drag tension by such spring 74 on the ribbon 24. The arm 82 operates against the action of a coil-type compression spring 86 having the upper end thereof engageable with a fixed journal portion 88 of the body of the cassette 22. The other end of the spring 86 engages a surface of the arm portion 64 and upon manual rotation of the pivot arm 82 through an angle of 90 degrees the movable arm 62 is caused to be raised upwardly at the left end thereof relative to the pivot 60 and the end of the leaf spring 74 is thus raised from the upper surface of the movable arm 62.

The present invention provides that the ribbon 24 take the form of a coil 90 when it is initially loaded or placed within the chamber of the cassette 22 formed by the back portion 42, the peripheral wall portion 44 and the cover 50. The ribbon 24 is unwound and directed in a path from the coil 90, around a guide 94 of the interior wall portion 58, around the upper right corner of the wall portion 58, and along the top of the movable arm 62 and under the leaf spring 74, with the spring 74 providing a drag on the ribbon 24. While FIG. 2 shows the endless ribbon 24 in the coil 90 within the cassette 22, it is understood of course that the end portion or loop of the ribbon 24 at the upper left of the cassette 22 is directed in a path out of the cassette 22 and past the printing station, as described in reference to FIG. 1 above, and then around the guides 38 and 40 prior to entering the chamber of the cassette 22 where the ribbon 24 takes the random or stuffing form 92 after passing between a pair of drive rollers 96 and 98.

Figure 3:
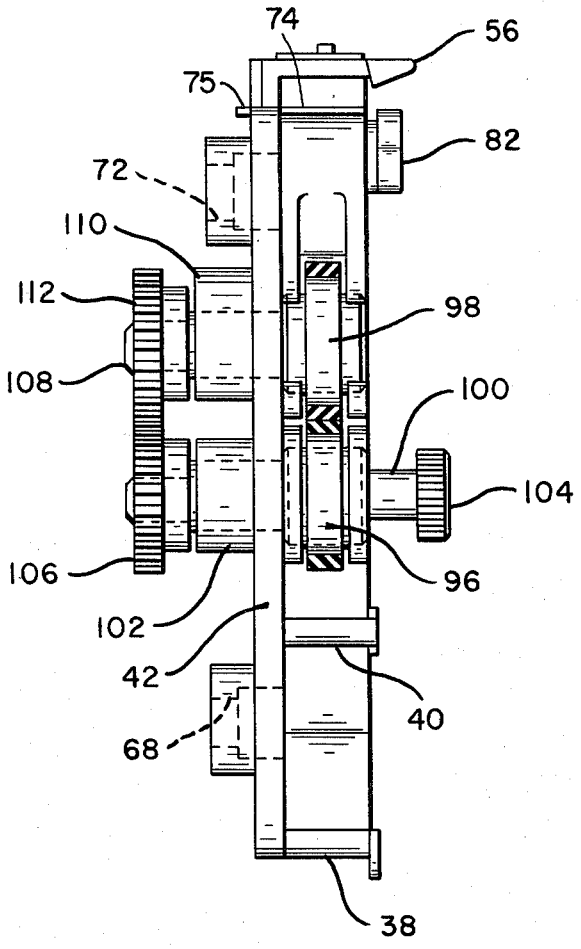
FIG. 3 is a left side elevational view of the cassette looking in the direction of arrows 3—3 of FIG. 2.

The lower drive roller 96 is in fixed position and is carried on a shaft 100, shown in FIG. 3, which is journaled in a bearing 102. The shaft 100 has a knurled knob 104 on the outer end thereof for operating the drive roller 96 by hand to adjust the slack in the ribbon 24. The other end of the shaft 100 has a gear 106 as a part of the drive mechanism for the ribbon 24.

Cooperating with the lower drive roller 96 is the upper drive roller 98 which is carried on a shaft 108 journaled in an elongated bearing 100 to allow for the up and down movement of the cassette arm portion 64 along with the drive roller 98 and an associated drive gear 112 carried on the shaft 108. The gear 112 is normally meshing with and driven by the gear 106, however, upon the 90 degree movement of the pivot arm 82, the support arm portion 64 along with the shaft 108 carrying the drive roller 98 and the gear 112 are moved upwardly so as to disengage the gear 112 from the gear 106. Each of the drive rollers 96 and 98 includes a rubber or like surface for engaging the ribbon 24. Looking at the front of the cassette 22 in FIG. 2, the drive roller 96 normally rotates clockwise with the roller 98 rotating counterclockwise, as shown by the arrows, to drive the ribbon 24 into the chamber of the cassette 22 to assume the stuffed form 92.

Figure 4:
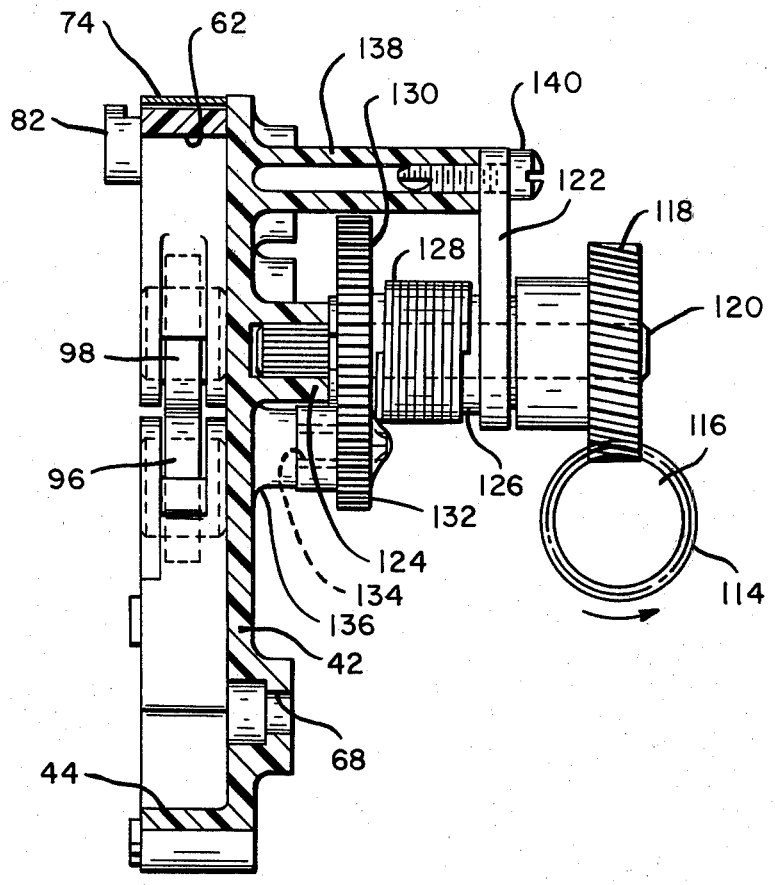
FIG. 4 is a sectional view of the cassette taken along the plane 4—4 of FIG. 2.

The input drive for the ribbon drive rollers 96 and 98 is obtained from a worm gear 114 (FIG. 4) carried on a cam shaft 116 and which is driven by means of a suitable timing belt (not shown) and driven by a D.C. motor (also not shown). The worm gear 114 is normally rotated in a counterclockwise direction and meshes with a cassette worm gear 118 carried on a shaft 120 journaled in a support plate 122 and in a bearing 124 which is formed as an integral part of the cassette 22. Adjacent the support plate 122 is a hub portion 126 around which is placed a clutch spring 128 to enable driving of the drive rollers 96 and 98 to drive the ribbon 24 in one direction into the cassette 22, but also utilized to enable taking-up of slack ribbon 24 outside the cassette 22. A drive gear 130 (see also FIG. 2) is carried on the shaft 120 and is meshed with a transfer gear 132 which in turn meshes with the gear 106 for driving thereof. The transfer gear 132 is carried on a shaft 134 formed as an integral part 136 of the cassette body. The support plate 122 is secured to a cantilever portion 138 of the cassette body by a pair of screws 140.

Figure 5:
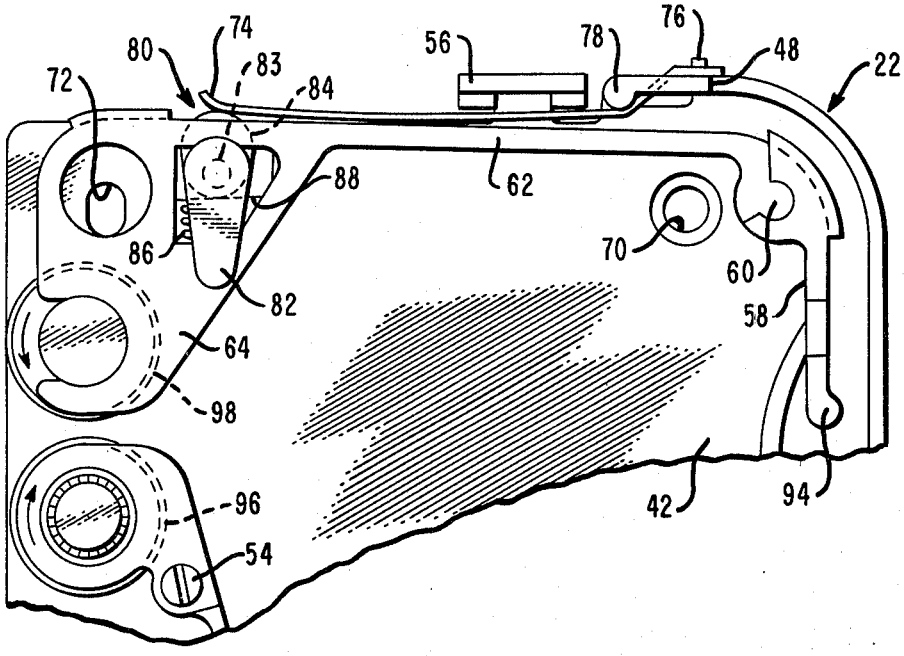
FIG. 5 is a view of a portion of the cassette of FIG. 2 with certain parts being in different positions for defining the ribbon loading condition thereof.

As specifically shown in FIG. 5, when the pivot arm 82 is rotated clockwise in the journal portion 88 of the body of the cassette 22, a central portion of the axis of the pivot arm 82 engages a lower surface of the movable arm 62 just above the pivot 83 and raises the entire arm portion 64 of arm 62 against the bias of the coil spring 86. It is noted that the upper end of the coil spring 86 is held stationary against a surface of the journal portion 88 of the body of the cassette 22 whereas the other or lower end of the coil spring 86 is against a surface of the arm portion 64 and is caused to move upwardly with the arm portion and thereby compress the spring 86. At the same time that the movable arm 62 is pivoted about the pivot 60, the finger 84 of the pivot arm 82, which finger 84 extends outwardly from the circumference of the arm axis and is positioned rearwardly of the axially central portion of the pivot arm 82, engages the rearward portion 75 of the leaf spring 74, seen in FIG. 3, and raises the left end of the spring 74 from the upper surface of the movable arm 62 to provide a throat therebetween for free passage of the ribbon 24 when loading the cassette 22.

In the operation of the reloadable cassette 22, a coil or spool 90 of ribbon 24 having a loop end accessible on the periphery of the coil 90 is placed into the chamber of the cassette 22 when the upper portion of the cover 50 is opened on the hinge 52. The loop end is then trained from the cassette 22 and directed in the path and manner, as shown in FIG. 1. As the printer 10 is operated, the ribbon 24 is caused to be uncoiled from the coil 90 within the chamber of the cassette 22 and after passing the printing station the ribbon 24 is returned to the chamber to be contained therein in random or stuffing form 92. For a period of time, the greater portion of the ribbon 24 is in the coil 90 with a lesser portion in random form 92. Further operation reduces the size of the coil 90 and more of the ribbon 24 is then stored in the cassette 22 in the stuffed form 92. When the coil or spool 90 of the ribbon 24 is completely unwound, the ribbon 24 then operates and appears in the stuffing form, as shown at 92, within the cassette 22 and until the ribbon life is exhausted. The stuffed form 92 of the ribbon 24 is then removed and a new coil 90 of ribbon 24 is placed or loaded into the cassette 22.

It is thus seen that herein shown and described in a reloadable ribbon cassette for a printer or like machine wherein a coil of ribbon in compact form is placed into the cassette and, as the coil of ribbon is unwound during operation of the printer, the ribbon is returned to the cassette in stuffing form. The cassette of the present invention enables the accomplishment of the objects and advantages mentioned above, and while a preferred embodiment has been disclosed herein, variations thereof may occur to those skilled in the art. Therefore, it is contemplated that all such variations and modifications not departing from the spirit and scope of the invention hereof are to be construed in accordance with the following claims.

What is claimed is:

1. In a printer, a ribbon cassette having an enclosure for receiving a coil of endless ribbon,
- means for training an end loop portion of said ribbon in a path from an exit of said cassette and across the printer along a path spaced from and then past a printing station,
- leaf spring means for tensioning said ribbon when training the end loop portion thereof from the cassette exit,
- roller means operably connected with the printer for driving the ribbon through an entrance of and back into the cassette and forming the ribbon in random folds within the enclosure of said cassette after driving the ribbon through the entrance thereof while unwinding ribbon from the coil, and
- cam means rotatably journaled and connected with said cassette for releasing said leaf spring means and for disengaging said roller means during loading of said ribbon cassette.

2. The ribbon cassette of claim 1 including means for threading the end loop portion of said ribbon through a passageway of said cassette and along a path adjacent the printing station.

3. The ribbon cassette of claim 1 including clutch means for driving said ribbon in one direction.

4. The ribbon cassette of claim 1 wherein said training means includes fixed and movable guide members for training the ribbon in a loop around said printing station.

5. The ribbon cassette of claim 1 wherein said enclosure includes a door portion operable for removing random folds of ribbon and for reloading a coil of ribbon.

6. The ribbon cassette of claim 1 wherein said roller means includes a drive roller and an idler roller and said cam means comprises an arm having a finger thereon engageable with said leaf spring means for releasing the tension on said ribbon when moving the idler roller from the drive roller.

7. In a printer including a printing station, a reloadable ribbon cassette having a
- chamber for receiving a coil of endless ribbon with a loop portion,
- means for guiding said loop portion from an exit of said chamber along a path spaced from and then past the printing station and thence into an entrance of the chamber,
- leaf spring means for tensioning the ribbon when guiding the loop portion from the chamber exit,
- drive and driven roller means operably connected with the printer for driving the ribbon through the chamber entrance and forming random folds of ribbon within the chamber while unwinding ribbon from the coil, and cam means rotatably journaled and connected with said cassette for releasing said leaf spring means and for disengaging said drive and driven roller means during loading of said ribbon cassette.

8. The ribbon cassette of claim 7 wherein said guiding means includes fixed and movable guide members for training the loop portion in the path along the printing station.

9. The ribbon cassette of claim 7 wherein said chamber includes a door portion for removing random folds of ribbon and for reloading a coil of endless ribbon.

10. A ribbon cassette for use in a printer and comprising an enclosure for receiving a coil of endless ribbon having a loop portion, means for training the loop portion from the enclosure along a path across the printer and past a printing station and thence back into the enclosure, spring means for tensioning the ribbon when training the loop portion from the enclosure, roller means operably associated with the printer for driving the ribbon back into the enclosure and forming random folds of ribbon within the enclosure while unwinding ribbon from the coil, and cam means rotatably journaled on the enclosure for releasing the spring means and for disengaging the roller means during loading of ribbon in the cassette.

11. The ribbon cassette of claim 10 wherein said spring means comprises a leaf spring adjacent an exit of the enclosure.

12. The ribbon cassette of claim 10 wherein said roller means comprises a drive roller and an idler roller and said cam means engages said spring means for releasing the tension on the ribbon.

13. The ribbon cassette of claim 10 wherein said cam means comprises an arm having a finger thereon engageable with the spring means for releasing the tension on the ribbon.

14. The ribbon cassette of claim 10 wherein the roller means comprises a drive roller and an idler roller and the cam means comprises an arm having a finger thereon engageable with the spring means for releasing the tension on the ribbon when moving the idler roller from the drive roller.

* * * * *